US007019652B2

(12) United States Patent
Richardson

(10) Patent No.: US 7,019,652 B2
(45) Date of Patent: Mar. 28, 2006

(54) DETERMINING THE EFFICIENCY OF RESPIRATORS AND PROTECTIVE CLOTHING, AND OTHER IMPROVEMENTS

(75) Inventor: Grant Stuart Richardson, Salisbury (GB)

(73) Assignee: The Secretary of State for Defence, (GB)

( * ) Notice: Subject to any disclaimer, the term of this patent is extended or adjusted under 35 U.S.C. 154(b) by 169 days.

(21) Appl. No.: 10/168,159

(22) PCT Filed: Dec. 12, 2000

(86) PCT No.: PCT/GB00/04755

§ 371 (c)(1),
(2), (4) Date: Jun. 17, 2002

(87) PCT Pub. No.: WO01/43827

PCT Pub. Date: Jun. 21, 2001

(65) Prior Publication Data

US 2002/0190866 A1 Dec. 19, 2002

(30) Foreign Application Priority Data

Dec. 17, 1999 (GB) ..... 9929745

(51) Int. Cl.
*G08B 23/00* (2006.01)

(52) U.S. Cl. ..... 340/573.1; 340/517; 128/202.22

(58) Field of Classification Search ..... 340/573.1, 340/500, 539.1, 632, 539.13, 517, 524; 128/202.22, 128/200.24; 348/82
See application file for complete search history.

(56) References Cited

U.S. PATENT DOCUMENTS

| | | | | | |
|---|---|---|---|---|---|
| 3,923,053 | A | * | 12/1975 | Jansson | 128/205.12 |
| 4,846,166 | A | * | 7/1989 | Willeke | 128/200.24 |
| 5,018,518 | A | * | 5/1991 | Hubner | 128/202.22 |
| 5,157,378 | A | * | 10/1992 | Stumberg et al. | 340/521 |
| 5,323,774 | A | * | 6/1994 | Fehlauer | 128/206.12 |
| 5,433,612 | A | | 7/1995 | Daku | 434/226 |
| 5,513,854 | A | | 5/1996 | Daver | 273/454 |

(Continued)

FOREIGN PATENT DOCUMENTS

DE 19503027 3/1996

(Continued)

*Primary Examiner*—Phung T. Nguyen
(74) *Attorney, Agent, or Firm*—Dean W. Russell; Kristin M. Crall; Kilpatrick Stockton LLP

(57) ABSTRACT

A respirator system (10; 100) for a worker in an environment with hazardous airborne contaminants comprises a respirator (12, 112), a helmet (14, 114), a camera (40, 140), and a gas sample analyser (16, 116) capable of analysing samples of gas from within the respirator and in the immediate area near the user. An RF emitter (20, 120) sends a signal to a remote receiver (24, 124). The emitted signal is a real time view through the camera (40, 140) and overlaid on that is a graphical representation of the protection factor being achieved by the respirator. The system (100) may also have a data storage device (162, 170) to store data such as how protection factor varies with time and may have a position sensor (160). The provision of the position sensor (160) allows a map of contamination levels with position to be built up as a user moves around a site.

29 Claims, 6 Drawing Sheets

U.S. PATENT DOCUMENTS

| | | | | |
|---|---|---|---|---|
| 5,659,296 | A | 8/1997 | Debe et al. | 340/632 |
| 5,860,418 | A * | 1/1999 | Lundberg | 128/202.22 |
| 5,950,621 | A | 9/1999 | Klockseth et al. | 128/204.26 |
| 5,990,793 | A * | 11/1999 | Bieback | 340/573.1 |
| 6,199,550 | B1 * | 3/2001 | Wiesmann et al. | 128/204.23 |

FOREIGN PATENT DOCUMENTS

| | | |
|---|---|---|
| DE | 19822412 | 11/1999 |
| EP | 0691559 | 1/1996 |
| FR | 2741853 | 6/1997 |

* cited by examiner

DETERMINING THE EFFICIENCY OF RESPIRATORS AND PROTECTIVE CLOTHING, AND OTHER IMPROVEMENTS

This invention relates to the efficiency of respirators, protective clothing (e.g. full body suits), and to other ideas that have developed out of that work.

Although not limited to the field of respirators the invention arose in that field and it is convenient to discuss it as an example.

Respirators are used by a large number of workers to protect their face and eyes from a harmful environment, and to clean the air they breathe, protecting their mouth, throat and lungs. Examples of people who use respirators include workers in chemical factories where there are noxious vapours, nuclear power workers, miners and quarrymen where there is harmful dust in the atmosphere, fire-fighters, and laboratory workers working with very dangerous materials, to name but some. Another area where respirators, or face pieces, are worn is in diving, where they do not clean the ambient air, but provide breathable gas from a tank or line.

Some workers have to do strenuous physical activity whilst wearing their respirator and it is important that the respirator is effective in keeping out the harmful substances from the surrounding atmosphere.

The performance of respirators from a particular harmful substance is measured as a Protection Factor (PF)—how much substance is getting through compared to how much is in the surrounding atmosphere. At present there are tests performed in a laboratory to determine the Protection Factor of a respirator/mask (e.g. the CEN standard test developed at Porton Down is widely used for industrial respirator testing and involves a hydrogen flame photometer to test for levels of sodium chloride). A volunteer puts on a respirator which is wired up to the analytical equipment. The Protection Factor (PF) is calculated by measuring the concentration inside the respirator. The volunteer is, of course, in a test chamber. He can perform some exercises in the chamber, for example cycling on a stationary bicycle, or stepping on an exercise machine, running on a treadmill, etc.

It has become apparent over the past years that the Protection Factor of a respirator measured in a test chamber is not really how effective it is likely to be in practice. In the tests the test respirator may be sized for the volunteer and is fitted and adjusted to the volunteer by an expert, or the volunteer is themselves an expert (e.g. one of the laboratory staff), and the respirator is of the correct size, and is well maintained. This enables a maximum achievable Protection Factor to be measured. Moreover the test is relatively short (about fifteen minutes), and the exercises are not representative of the real conditions of use, and so the strains on the respirator are not really replicating what will be experienced in practice.

To take into account the above there are suggestions to have an "assigned Protection Factor" given to a respirator, which is only a fraction of their laboratory-measured Protection Factor.

One possibility to improve the match between measured Protection Factor and the achieved Protection Factor in the field is to test respirators using mobile field laboratories and test real workers/firemen, etc. using their own respirator, donned without assistance. This still would result in a volunteer being tested in a sealed chamber—an artificial and too-controlled environment, and it would still be a short test. The exercises that a volunteer can perform in the laboratory chamber are not realistic enough for very active wearers, such as firemen or other rescue workers (for example).

According to a first aspect the invention comprises a portable respirator system having a respirator, a sensor adapted to sense the level of a substance inside the respirator and output a sensor signal, indicative of the level of said substance inside the respirator, to a signal handler comprising either (i) data storage adapted to store data representative of the sensor signal; or (ii) a telecommunication emitter adapted to emit a telecommunications signal indicative of the sensor signal, or (iii) both (i) and (ii); and in which the sensor, signal handler, and respirator are all adapted to be worn or carried by a mobile user.

Preferably the sensor is also adapted to sense the level of said substance in the environment outside of the respirator. The sensor may comprise a gas analyser, or particle counter, and may be coupleable to internal air of the respirator, and to atmospheric air.

Thus, with a portable test unit/sensor, a user can wear the respirator system for prolonged periods (e.g. hours, possibly five, ten, or even twenty-four hours or more at a time) and can actually perform duties that they would "for real" perform, in their actual work environment, so that the Protection Factors established would be meaningful. For workers who work in the same place, e.g. industrial workers, they would simply perform their job wearing the respirator system to gather the Protection Factor data. For mobile response teams, such as fireman, military, or police, they could wear the respirator system on realistic exercises. The mobile, Protection Factor-establishing, respirator system can be used whilst personnel perform their normal duties in the field, in a real environment, and whilst they are carrying or wearing other equipment that may effect performance. The effect of long term wear of a respirator, and how Protection Factor may change with time, can be monitored (e.g. beard growth, sweat, changes in face morphology due to extended wear).

The system preferably adapted, in use, to take sensor readings of the level of substance within the respirator periodically, for example at least every 15 seconds, 30 seconds, 1 minute, 2 minutes, 5 minutes, 10 minutes, 30 minutes, an hour, or more, or within ranges defined by any of those points. Alternatively the sensor may take substantially continuous measurements of contaminant levels, possibly alternately in the mask of the respirator and in the atmosphere in the vicinity of the user, outside of the respirator. Of course the above relies upon there being a portable analyser/tester to monitor the level of a substance inside and outside of the respirator. A particle counter may comprise the tester, and the CLC "portacount" system from TSI, Inc. of Minnesota, USA, is one suitable detection system. A sample from outside of the mask/respirator can be tested, and a sample from inside the mask/respirator. The analyser could be a gas analyser, or it could be a particle counter (for example a laser and detector particle counter) or any other suitable device.

Preferably the system includes a data store, which may be a computer memory, or magnetic tape, or optical memory, or optical or magneto-optical recording medium.

Preferably, the system includes a camera adapted to be mounted on the user (e.g. worn or ported by them). The system may comprise a helmet and the camera may be provided associated with the helmet. Alternatively, the camera may be associated with the respirator, or with a hood of a garment. The data store (if provided) may record what is output by the camera. The emitter (if provided) may emit signals associated with the output of the camera. There may be a machine-readable data carrier removably couplable to a data recording device, for example a magnetic tape in a video recorder (e.g. DVR), or a CD, or a DVD, or a MD (magnetic disc).

Thus, a record of what the user is seeing/doing can be captured. The system preferably correlates the sensor signals taken (correlation may be performed periodically) with camera image signals, so that an observer of the recorded data, or transmitted data, can see what the camera was seeing when detected signals fluctuate, or see what the detected signals do when the user performs certain acts (as evidenced by the camera image signals). Signal correlation may be provided. Preferably, the detector signals and/or camera signals are time correlated. A clock may be provided in the system to do this The camera signals may be stored on video tape, or video recording medium. The sensor signals may also be stored on the video recording medium.

A breathing sensor may be provided associated with the respirator. This may be used to establish whether the user is wearing the respirator and breathing in it. If signals inconsistent with this are generated by the breathing sensor it may mean that the user is not wearing the respirator (possibly when they should be), or that they have stopped breathing/have impaired breathing. Both of these indicia are of course very useful to a training supervisor or operational commander, and both may cause the supervisor/commander to take remedial action.

The breathing sensor is preferably provided in addition to the level-of-substance sensor, and may use the same telecommunication emitter if one is provided, or may use a separate emitter. Alternatively, the breathing sensor may be provided instead of the level-of-substance sensor, in which case the respirator system is not so much a system for checking that the respirators are working properly as a system for checking that they are being worn and that the users are breathing and/or their pattern of breathing. Preferred embodiments of the respirator system do both.

The breathing sensor may comprise a pressure sensor adapted to sense the air pressure inside the respirator, and the system may possibly monitor the cyclic rise and fall of air pressure with exhalation/inhalation. The breathing rate may be monitored. A processor, carried by the user or remote from the user, may convert signals from the breathing sensor (e.g. pressure transducer) to air flows and/or breathing rate. The air flow and/or breathing per minute information can be used to determine if the wearer of the respirator is working hard physically (e.g. high flow rates/high breathing rate) or is at rest physically. High breathing rates may also be associated with stressful situations, possibly with a different flow rate than vigorous exercise (e.g. fast shallow breathing versus fast deep breathing). Breathing rates, or changes in them, may also be used to indicate failure or partial failure of the respirator mask to keep out harmful substances.

Providing breathing data to a remote location allows a commander to evaluate the physiological status of the people involved in the exercise.

The system may have a position sensor adapted to provide a signal from which the position of the respirator in space can be determined. The position sensor may be a global position sensor, or a triangulation sensor, or a proximity sensor. The position sensor is preferably adapted to provide position data to the signal handler for storage in the system, transmission, or both. The position is preferably correlated (e.g. by time stamping it) with one or more of: camera image, —protection factor, —contaminant level outside of the respirator, preferably immediately adjacent the respirator; contaminant level inside the respirator; physiological data indicative of an aspect of the wearer's/user's physiological activity.

Preferably the system has image and data combination or association means adapted in use to associate a parameter detected by a sensor of the system (or a value calculated from one or more sensor signals) with the image recorded by the camera so that a combined or associated processed image is produceable in use with the parameter or value displayed at the same time as the camera image. Preferably the system is adapted to display the parameter or value at the periphery of the camera image, most preferably at one edge.

The respirator system may have an indicator adapted to indicate information to the user. The indicator may be visual, for example a light. The indicator may be provided on the respirator mask, possibly adjacent an eye window. The indicator may be adapted to indicate to the user that the respirator is not succeeding in maintaining a safe breathable atmosphere within the respirator. The indicator may be a light, for example an LED. It may flash when indicating, it may be disposed in use at the peripheral vision of a user. The indicator may be adapted to be activated by an automatic device provided in the respirator system (or in telecommunication with it) which processes detected contaminant signals and automatically alerts a user if they are outside of a defined allowable range. Alternatively, or additionally, a remote telecommunication unit may be capable of activating the indicator under the manual control of an operator.

The respirator system may comprise a suit adapted to be worn by a user. Indeed, the suit may provide a protected or filtered interior which a person can occupy.

According to a second aspect the invention comprises the combination of (i) a system according to the first aspect of the invention having a transmitter and (ii) a receiver system, the receiver system having a receiver adapted to receive transmitted signals and a processor and a display, the processor in use processes the received signals and in use providing the display with display signals which generate a visual representation of a parameter by the sensor signal.

Preferably the processor and display are adapted to display a visual image recorded by a camera provided with the respirator system. The receiver system preferably has a transmitter adapted to transmit signals to the respirator system, which has a receiver.

According to a third aspect the invention comprises a method of determining the efficacy of a respirator comprising providing a sensor associated with a respirator to detect the contaminant level inside the mask of the respirator, detecting the contaminant level outside of the respirator, and providing a portable analyser adapted to determine the contaminant levels inside and outside of the respirator mask and comparing the contaminant levels inside and outside of the mask.

The method may comprise detecting the contaminant level in the vicinity of the user of the respirator.

Preferably the method comprises having the user of the respirator perform exercises in a workplace environment, for example in a factory, or building, or outdoors. Preferably the method comprises a method of determining the efficacy of a respirator in its normal expected usage comprising having the user perform their normal expected duties whilst wearing the respirator and whilst transporting the analyser.

The method preferably comprises informing a remote station of the results of the test in real time by having the respirator and associated analyser in communication (possibly telecommunications) with the remote station. Preferably the test data is recorded in a recording device ported (e.g. carried by/worn by) the user of the respirator. Preferably the position of the user is determined.

Preferably visual images are recorded whilst the user undergoes the test of the respirator. Preferably the test data relating to the performance of the respirator is associated with the recorded images. The test data, or a parameter derived from the test data, may be visually displayed simultaneously with the visual images, preferably adjacent the visual images. Preferably other data, such as physiological data, is also recorded during the test and may also be correlated with the visual images, and/or respirator performance data.

According to a fourth aspect the invention comprises a data carrier having recorded on it data from the sensor of the system of the first aspect of the invention, or values derived from such data, and a visual history of what is observed by a camera provided as part of the system of the first aspect of the invention.

According to a fifth aspect the invention comprises a programmed data carrier carrying instructions which when run on a computer instruct the computer to process signals received by the signal handler of the system of the first aspect of the invention so as to evaluate the protection factor of the respirator.

Preferably the instructions also cause a visual record from a camera of the respirator system to be combined with or associated with a visual representation of a contemporaneous record of something monitored by the respirator system, or something derived from monitored signals. Preferably the instructions also cause the combined or associated signals to be displayed together, in use, as a combined display.

According to a sixth aspect the invention comprises using a person as a mobile sensor by providing them with one or more sensors, detecting environmental conditions in the vicinity of the person using the sensor(s), moving the person around an area so that conditions at a plurality of locations within the area are established, and creating a mapping of environmental conditions with location for the area.

Preferably the mapping comprises a correlation between location and level of airborne contaminants.

Any of the previous aspects of the invention may enable the fifth aspect of the invention to be performed.

Preferably the mapping is built up whilst the person carries out their usual duties. Preferably a map of airborne hazard level Vs position in an industrial environment, such as a factory, laboratory, mine or quarry is created. The person may carry a camera, which may be a video camera.

Telemetry may be relied on to communicate signals from the person to a base station. Use of telemetry is advantageous because it may reduce the complexity/size of the apparatus that is carried by the person. Further, it may make the data produced by the system more secure (apparatus holding the data may be more secure if it is part of a base station compared to apparatus that is carried by a person in a hazardous environment).

The base station may comprise a processing means (which may be part of a computer) and the processing means may be adapted, in use, to review the data transmitted to it using the telemetry. A signal transmitted to the base station may contain therein a parameter signal that may relate to conditions surrounding the person. If the parameter signal falls outside an allowable range (or may be within a range) then the camera carried by the person may be caused to operate. The images from the camera (which may be a video stream) may be fed to the base station via the telemetry. The camera may be caused to operate for a preset period, or may be to operate until the parameter signal is back in an allowable range, or may be for a predetermined time after the parameter signal is back within the allowable range.

According to a seventh aspect of the invention an environmental mapping system comprises sensor equipment carriable by a single person, position sensing equipment carriable by the same single person, and environmental sensor signal and position sensor signal handling means adapted either to i) record the environmental and/or position or ii) transmit the environmental and/or position sensor signals to a remote unit or iii) both i) and ii).

The system may or may not comprise a camera which, if provided, may function as described in association with any of the other aspects of the invention.

The mapping system may be provided in association with a respirator, or may not have a respirator provided at all. The system may be provided in association with a helmet. The sensors and/or camera and/or position sensor may be provided on the helmet. Alternatively, one or more of the sensor/camera/position sensor may be provided on a back pack. However, in perhaps the preferred embodiment the sensor and camera (if provided) are provided mounted on the helmet and the position sensor is carried on a pack about a user's body (possibly a back pack).

According to an eighth aspect the invention comprises a method of monitoring the performance of respirators in life-like operational situations comprising providing one or more people with a respirator system in accordance with the first aspect of the invention and observing the signals handled by the signal handler or observing parameters derived from those signals.

The sensor(s) may sense one or more physiological variables of the user having the camera.

According to a ninth aspect the invention comprises a method of monitoring the performance of people in life-like operational situations comprising having one or more of the people performing their duties wear or carry a camera and also wear or carry one or more sensors, and producing processed images of the camera images, the processed images comprising the images recorded by the camera and also visually display simultaneously the contemporaneous sensor value or value derived from the sensor value.

The apparatus may be adapted to overlay graphical information onto an image produced by the camera.

Preferably the sensors sense airborne contamination level of a substance. They may sense instead, or additionally, one or more physiological variables of the user having the camera.

According to a tenth aspect of the invention there is provided an apparatus comprising a camera and one or more sensors, the camera and the or each sensor are adapted to be worn by an individual, and further, the apparatus being adapted, in use, to produce a processed image of the camera image, the processed images comprising the images recorded by the camera and also visually displayed simultaneously the contemporaneous sensor value or value derived from the sensor value.

Thus an apparatus is provided that overlays graphical information onto an image produced by the camera.

The camera image may be a video signal. A video signal is advantageous because it allows a scene to be continuously monitored.

According to an eleventh aspect of the invention comprises a programmed data carrier carrying instructions which when run on a computer instruct the computer to receive signals from the environmental mapping system of the sixth aspect of the invention and generate a map based upon the received signals.

According to a twelfth aspect of the invention there is provided a respirator adapted for use in any of the preceding aspects of the invention.

The respirator may have a part adapted for connection to an air tube (leading to an analyser). Alternatively, or additionally, it may have a probe to detect a parameter inside the face mask of the respirator. Some means for extracting an air sample may be provided.

Embodiments of the invention will now be described by way of example only, with reference to the accompanying Figures, of which:

Figure 1:
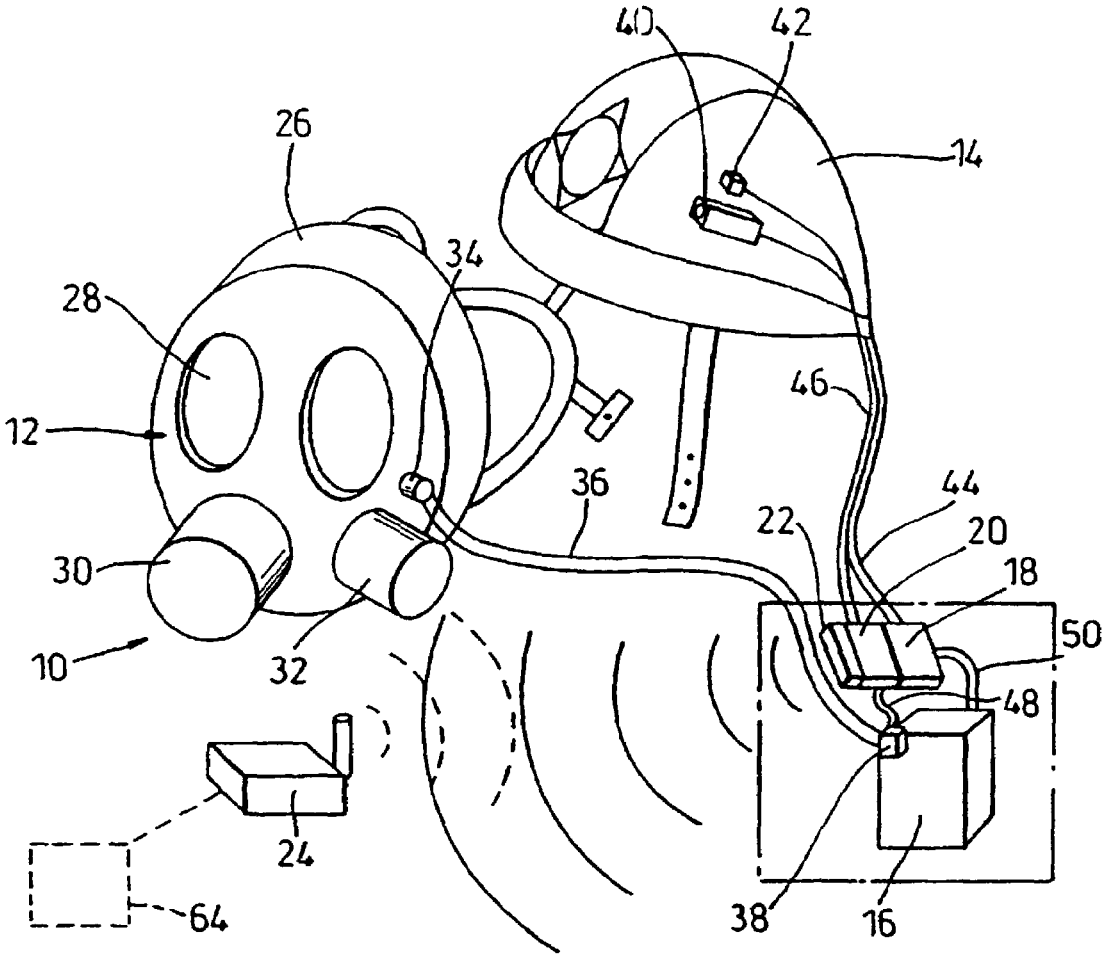
FIG. 1 shows a respirator system according to the present invention.

FIG. 1 shows a respirator system 10 comprising a respirator 12, helmet 14, a test analyser 16, a battery 18, a control unit 20, an RF emitter 22, and an RF receiver unit 24. (The skilled person will appreciate that where the term RF is used this could alternatively, or additionally, be an IR emitter, or indeed an emitter of any other type of suitable wave). It will be appreciated from the discussion hereinafter that the respirator system 10 is carriable/wearable by the same person who can still run/climb/crawl.

The respirator 12 has a rubber face seal 26, eye windows 28, inflow and outflow units 30 and 32 and an air port 34, connectable (releasably or permanently) to a gas-connection tube 36 leading to the test analyser 16. The analyser 16 has a valve unit 38 which is adapted to couple an air inlet of the analyser to the tube 36 or to atmosphere.

The helmet 14 has a camera 40 and a microphone 42, both connected to the battery 18 and to the control unit 20 by electrical cables 44 and 46.

The control unit 20 is connected to the analyser 16 by electrical cable 48 and is connected to the battery 18 for the supply of power. The test analyser is connected to the battery 18 by cable 50.

Figure 2:
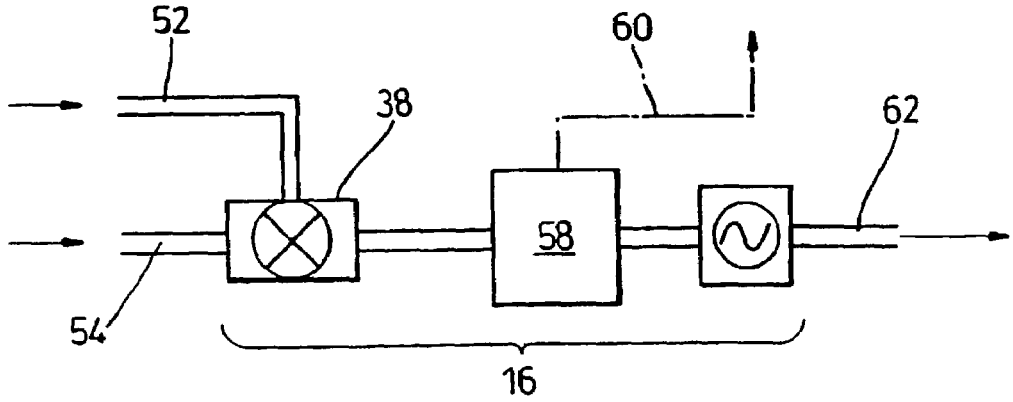
FIG. 2 shows schematic detail of part of a sensor of the system of FIG. 1.

FIG. 2 schematically illustrates the valve unit 38, and test unit 16. The valve unit 38 selectively couples either a mask sampling port 52, or an ambient atmosphere sampling port 54, of the face mask/respirator 12 with the test unit 16. The unit 16 has a pump 56 which draws air through a test sensor 58 which provides a sensor signal 60 to the control unit 20. Tested air is vented to atmosphere at vent 62.

The controller 20 controls the test unit 16 to perform Protection Factor tests (test of ambient air vs. respirator air) every 15 seconds (or other interval).

The video camera 40 and microphone 42 provide camera and audio signals to the controller 20 continuously (the camera signal may be a video signal). The controller 20 correlates the video, audio and sensor test signals by labelling them with a time and evaluates the Protection Factor and correlates the measured Protection Factor with the video and audio footage. The controller 20 controls the emitter 22 to emit RF signals containing data representative of the video footage, audio, and Protection Factor, in real time. The emitter 22 in this example emits in compressed bursts, but it could emit substantially continuously in real time.

Figure 3:
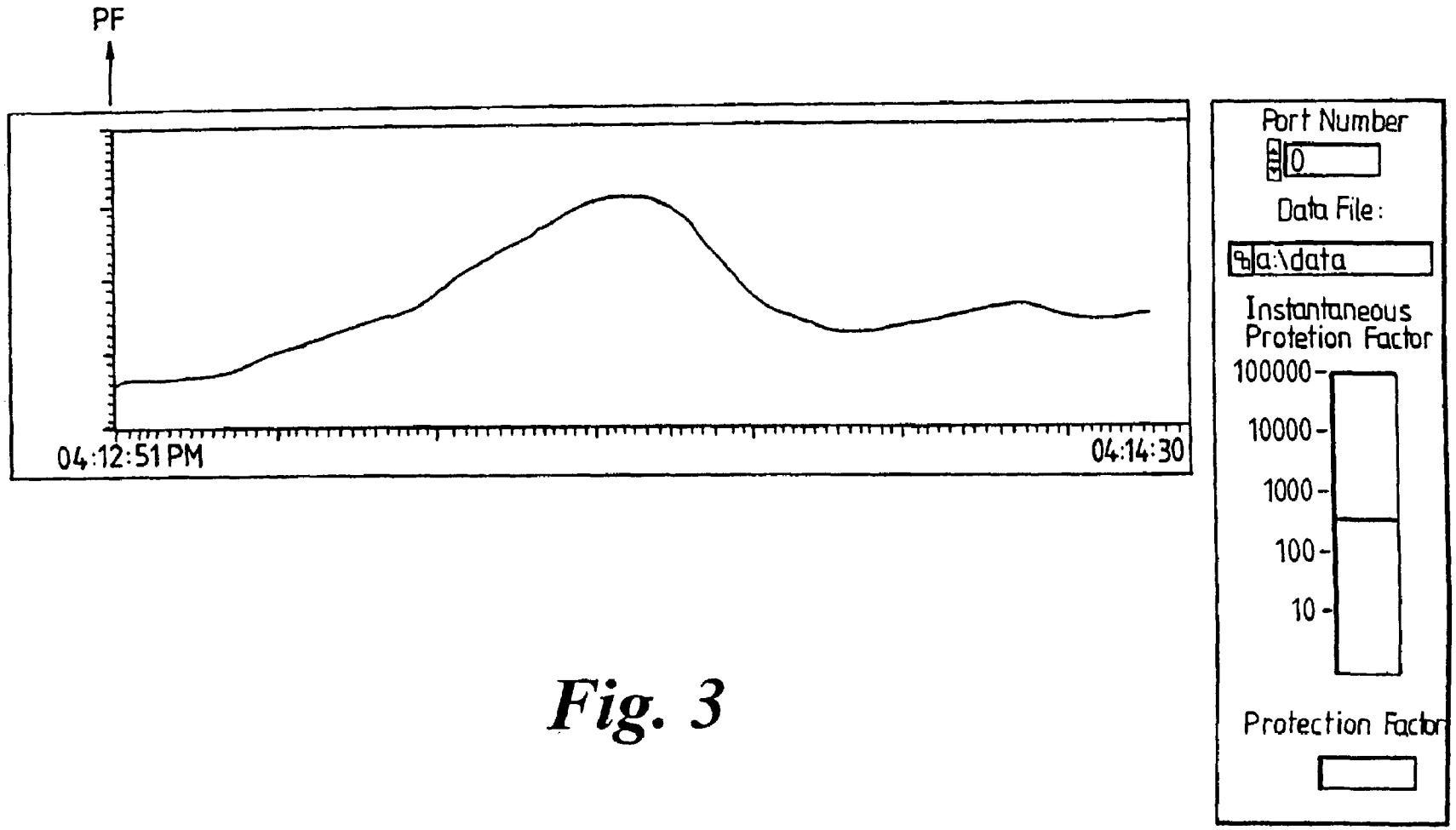
FIG. 3 shows a chart of Protection Factor over time obtained by the system of FIG. 1.

FIG. 3 shows a graph created in real time by a computer 64 linked to receiver 24, and shows how the Protection Factor of the respirator has varied in time over the test, as the person wearing the respirator has carried out different tasks, at different physical locations.

In a modification of the system of FIG. 1 a location device could be provided on the person to correlate the Protection Factor with their position. Moreover, signals representative of the amount of harmful substance/substance being detected could be transmitted as well as or instead of Protection Factor, and that information could be correlated with position. In this way, a map of concentrations of harmful substance with geographical position can be built up, using the person (and their equipment) as a mobile sensor.

It will be appreciated that the system of FIG. 1 can provide real time analysis of the Protection Factor achieved by the respirator, along with visual and/or audio coverage of the environment/commentary. The controller 20 may have a computer memory stored record of the sensor signals from the sensor unit and/or calculated protection factors and/or video footage/audio, and/or location or position record of the person.

This could be downloaded upon the return of the user to base. The telecom link may be superfluous in some applications, but it is preferred since it gives a substantially real time picture and analysis to a remote supervisor/control unit. This can be advantageous in some circumstances.

FIG. 1 also illustrates the fact that the test analyser 16, battery 18, control unit 20 and emitter 22 are all adapted to be carried by a user, who is independent and mobile. Chain-dotted line 70 illustrates a back pack, webbing or rucksack in which the items are carried.

Figure 4:
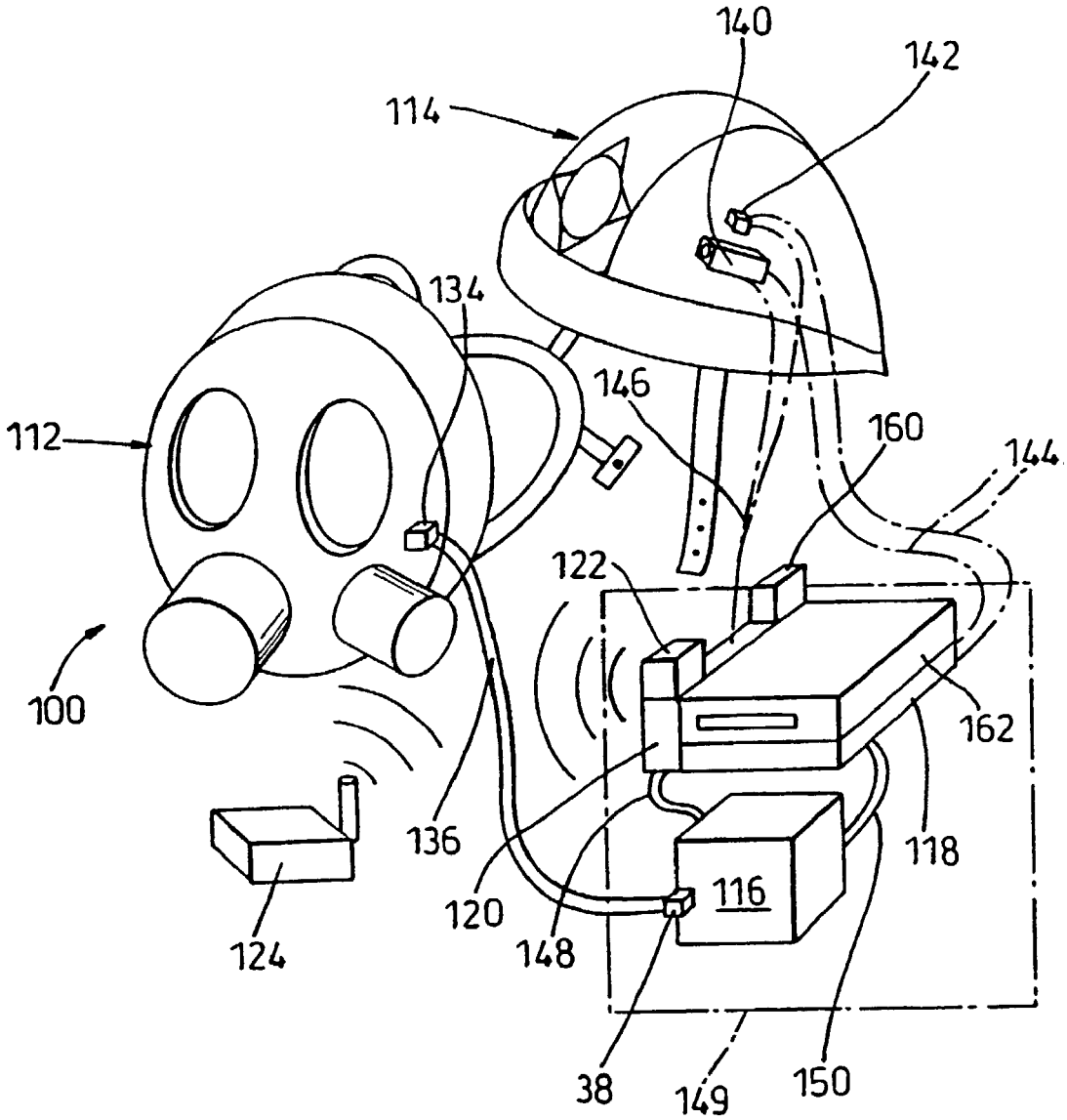
FIG. 4 shows an alternative respirator system.

FIG. 4 shows another respirator system, reference 100, which is similar to that of FIG. 1 but has some differences. The respirator system 100 comprises a face mask 112, a helmet 114, a test analyser 116, a battery 118, a control unit 120, a RF emitter 122 and a RF receiver unit 124.

The respirator has a sample port 134 and a gas connection tube 136 leading to the test analyser 116. The helmet 114 has a camera 140 and a microphone 142, both connected to the battery 118 and control unit 120 by cables 144 and 146. The control unit 120 is connected to the analyser 116 by cable 148 and to the battery 118. The analyser 116 is connected to the battery 118 by cable 150. A position sensor 160 is provided operatively connected to the control unit 120, and a video recorder 162 is also provided operatively connected to the control unit 120 and to the battery 118.

Instead of, or in addition to, a sample port 134, there may be a probe sensing the interior of the respirator mask.

The test analyser 116, the control unit 120, the RF emitter 122 and the position sensor 160 are shown within the chain line 149 and these items are provided in association with a back pack and so can be worn by a user. The items may be provided on the webbing of the back pack, on or in the back pack itself, etc.

The skilled person will appreciate that the RF emitter 122 in conjunction with the RF receiver 124 allows the apparatus of FIG. 4 to make use of telemetry. Microwave, infra-red, or other telecommunication links may be used.

Figure 5:
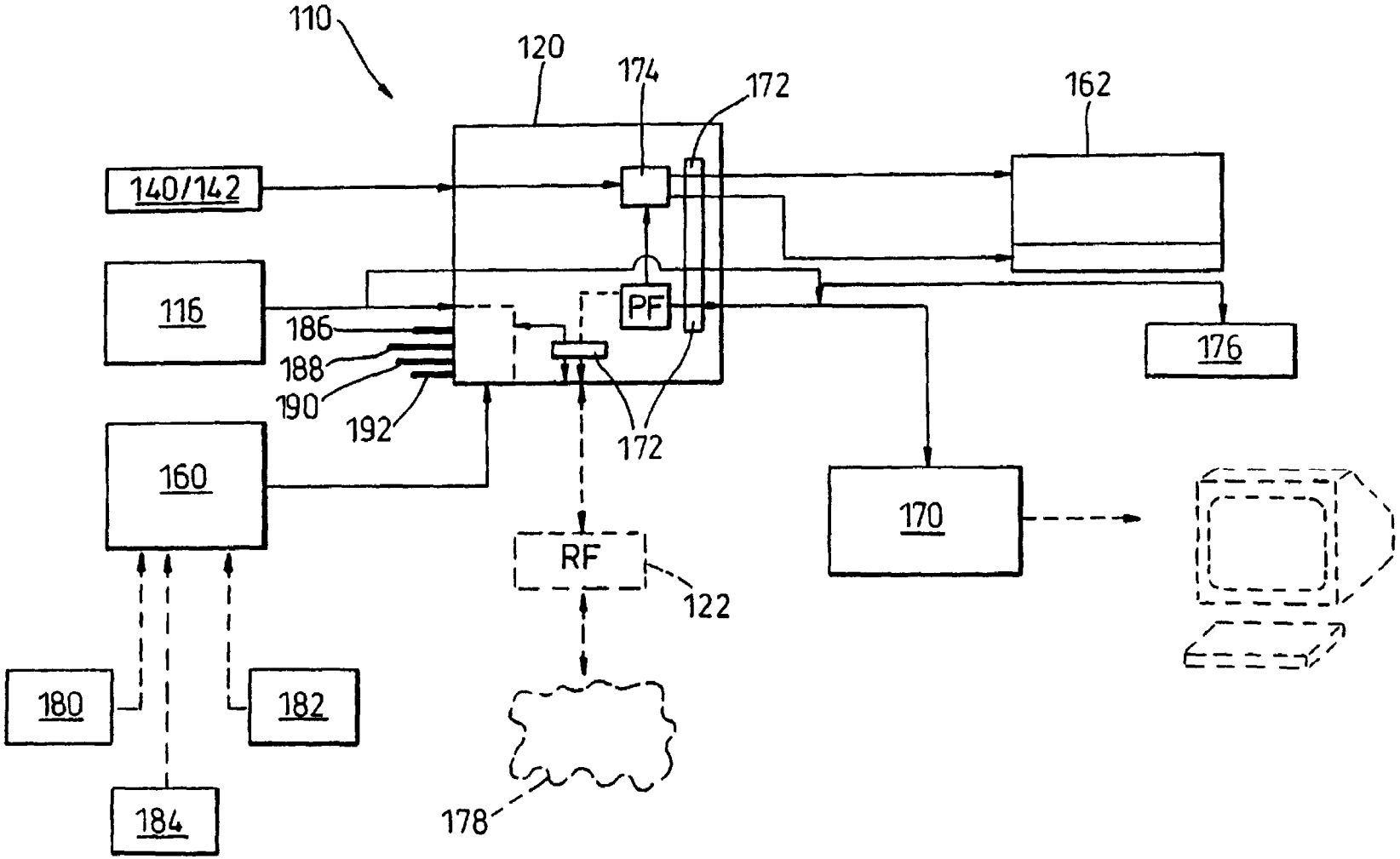
FIG. 5 shows schematically the operative components of FIG. 4.

The system of FIGS. 4 and 5 also has a cache memory 170 which in use stores the Protection Factor values, with associated times provided by a clock 172, and also the respirator and atmosphere sensor signals. This data can then be downloaded and readily processed by a computer.

The system 110 also writes the evaluated Protection Factor onto the video data storage tape used in the video recorder 162, using spare recording lines conventionally provided on video tape. A correlator function 174 is provided in the control unit 120 to do this. Again, the data is time-stamped. In the system of FIG. 4 the analyser 116 is continuously alternately analysing the ambient atmosphere near the user and the air within the respirator.

The system 110 has an alarm 176 which is triggered when the level of contamination in the respirator air approaches an unsafe level. The alarm may be an alarm sent back to a remote monitoring station, for that remote station, or supervisor, to call the operative back out of the danger area, or it may trigger an alarm that the user can themselves notice (e.g. audible alarm, or visual alarm, for example a LED at the periphery of the respirator eye windows. There may be an algorithm provided in the control unit 120 (or at the remote station) to determine whether to activate the alarm 176 automatically.

As will be seen from FIG. 5 the system 110 also has the capability to receive incoming telecommunications signals. An external telecommunications network or channel is illustrated at 178. The incoming signals could activate a user-detectable alarm, or could be audio signals (if a speaker were provided in the system, e.g. in the respirator or helmet), or the incoming signals could be control signals controlling the operation of the control at 120. For example, an external supervisor, or external control algorithm, could instruct the system 110 to change its frequency of analysis of respirator/ambient air, either up or down, or could tell it to monitor or process a different parameter, e.g. heart-rate.

FIG. 5 also shows that the position sensor 160 could be a Global Position Sensor (GPS) 180, i.e. satellite-based, or a land-based triangulation sensor 182, or a proximity sensor 184 or one or more proximity sensors, or any other position sensor system.

FIG. 5 also shows that there may be other sensor inputs to the control unit. For example, inputs 186 for heartbeat rate of user, 188 for internal mask pressure, 190 for $CO_2$ level, and 192 for body temperature are provided. These are also time-stamped by the clock 172 and either stored on the video cassette tape associated with the relevant video footage, stored in the cache memory 170, or exported out via the telecommunication channel 122, or any two of these, or all three. The other sensor inputs 186 to 192 to the control unit typically include analogue to digital converters. Breathing of the user may be monitored (e.g. by air pressure/flow sensors). The internal air pressure sensor producing the internal mask pressure signal 188 can be processed to determine the breathing rate, or whether the user is breathing (pressure varies with time as the user breathes and this can be monitored).

In one embodiment the controller 120 (or the controller 20 in the arrangement of FIG. 1) associates the Protection Factor data, or other sensed parameter (e.g. heart rate) with the camera image and also in some embodiments generates in real time a modified image which has the sensed parameter data visually displayed at the same time as the image viewed by the camera.

Figure 6:
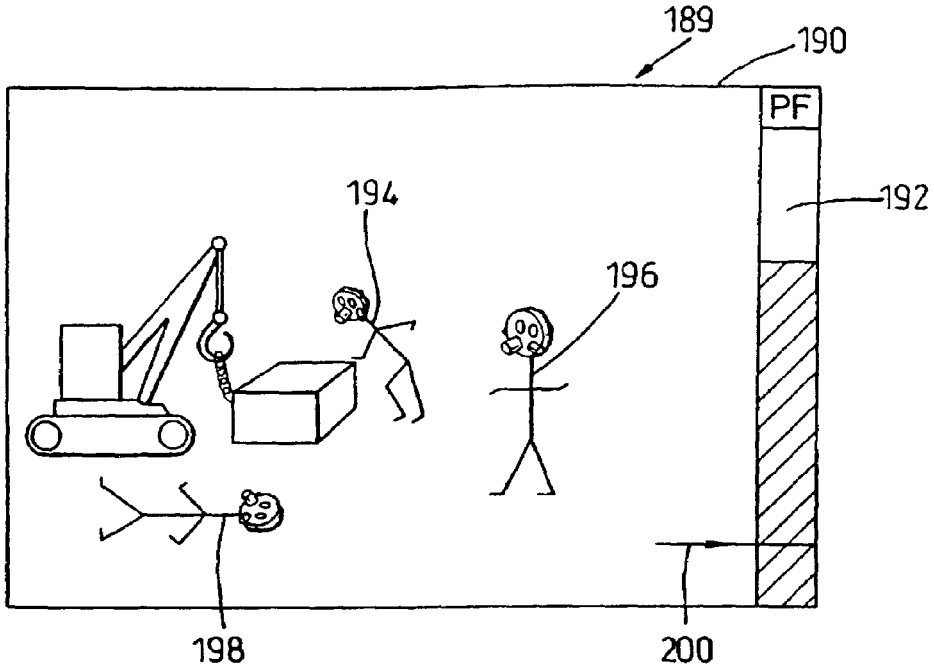
FIGS. 6 and 7 shows images obtained using the system of FIG. 1 or FIG. 4.
Figure 7:
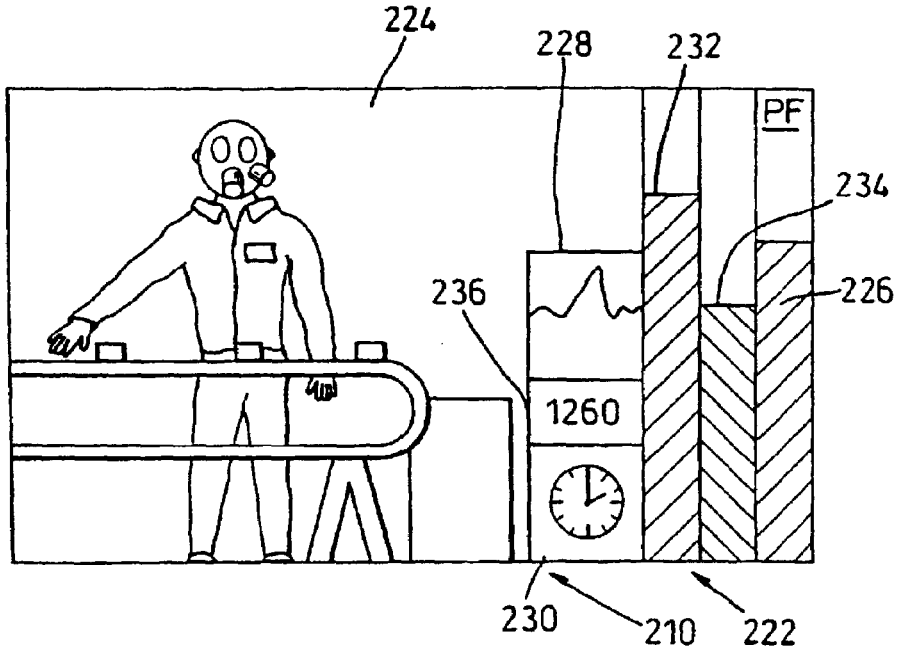

This is illustrated in FIGS. 6 and 7. FIG. 6 represents an overall image 189 generated by the respirator system of a user (not in view) approaching the scene of a chemical accident and shows that is seen by the user's camera, scene 190, and the instantaneous Protection Factor for the user in graphical form 192, at the periphery of the observed scene 190. In this example, a remote supervisor can see, via the camera of the human user, that two people 194 and 196 were trying to move a container of dangerous chemical and a third person 198 has been overcome with fumes due to a fault with their respirator, and that the two operatives 194 and 196 are just turning to assist their colleague 198. The image 189 also shows a level, referenced 200, at which the Protection Factor is considered to be dangerously low and at which an alarm would be triggered for the user wearing the respirator system.

FIG. 7 shows the image 210 generated by the respirator system of a user (not in view) who is looking at a colleague handling dangerous materials in a factory in a full body suit, including respirator. The graphical display 222 imaged with the camera image 224 has several parameters displayed: current Protection Factor 226, historical Protection Factor 228, time elapsed since system was activated 230, user heart rate 232, external temperature in the region of the user 234, and Geiger counter reading 236 (or external atmospheric contaminant reading).

The incorporation of telemetry into the respirator system allows the systems to be lighter, since not so much hardware is necessarily needed to be carried by the user of the system. The weight of the backpack could be about 2 kg with no large data recorder. (However, telemetry has other disadvantages in that some obstacles (e.g. hills or when inside a building/underground) can block the signal and so the received data can be patchy). The system of FIGS. 4 and 5 which records the data onto a data storage medium avoids these problems.

Another way of overcoming the break-up of telemetry signals due to obstacles is to use appropriate communications systems, for example mobile cell systems, repeaters, etc.

One reason why the system of FIGS. 4 and 5 stores the Protection Factors on both the video storage (e.g. DVC) and in computer memory for downloading is that the computer cache memory can be used to identify periods of interest (e.g. low Protection Factor) and the video can then be run from a predetermined time before the time of interest, or at around the corresponding time to get a visual record of what was happening. For example, the video can be run for 30 seconds before, during, and for 30 seconds after the Protection Factor falls below a threshold value. This may enable the person watching the video to see if there are any lessons to be learned. Having a computer automatically find a period of interest and automatically play the video record corresponding to the correct time is quicker, and better, than having a human watch hours of video evidence in case the Protection Factor falls to a dangerous level.

Similarly, when other parameters are measured the computer can be arranged to start the video at a time when something interesting is about to happen/is happening in relation to a selected other parameter (e.g. heart rate, or mask pressure).

The control/signal combining/image overlaying functions of the control unit 20 or 120 can be hardwired in for robustness, or software controlled. Alternatively, the mobile system may not process the signals, instead the signals could be communicated to the receiver system and processed/combined there.

A further advantage of using the respirator system is that in addition to checking/monitoring the efficiency of the respirator in genuine in the field conditions a video record of a training exercise can be generated. Indeed, several people in a training exercise or real emergency may each have a respirator system in accordance with the present invention and separate footage of the exercise from the point of view of different people, and separate evaluations of the Protection Factors, can be obtained. Getting the information back to the supervisor/main control unit in real time (with telecoms links) is also attractive.

As mentioned earlier, the respirator system can also be used as a system for communicating with the user, if appropriately modified. If the system has an alarm a user can be alerted to a danger of inadequate protection by an in-built alarm. For example there may be a light (e.g. LED) in the peripheral vision of a user indicating if the system is operating safely (e.g. green) or not (e.g. red). The danger light could flash. The alarm could be used by a remote commander as a communications system, possibly to recall a user, or if an appropriate code of flashing on/off lights were used to give other instructions. Audio facility to give a user instructions may be provided.

The system may be activated remotely by a supervisor. It can take hours for emergency personnel to deploy prior to entering a hazardous area and it may be desired not to have the system using significant battery power until the right time arrives. Alternatively the user may be able to activate the system.

The system may also be used to check whether a user has correctly fitted their respirator. For example if more than one user is in the same place and one has a significantly lower measured Protection Factor than the other it is a guide to check the fitting of the respirator.

Comparing respirator air tests with ambient air tests is one appropriate way of monitoring whether there are any problems with a respirator that is intended to protect a user from a hazardous environment. However, for people like divers what may be better is to check that the air is of breathable quality.

Figure 8:
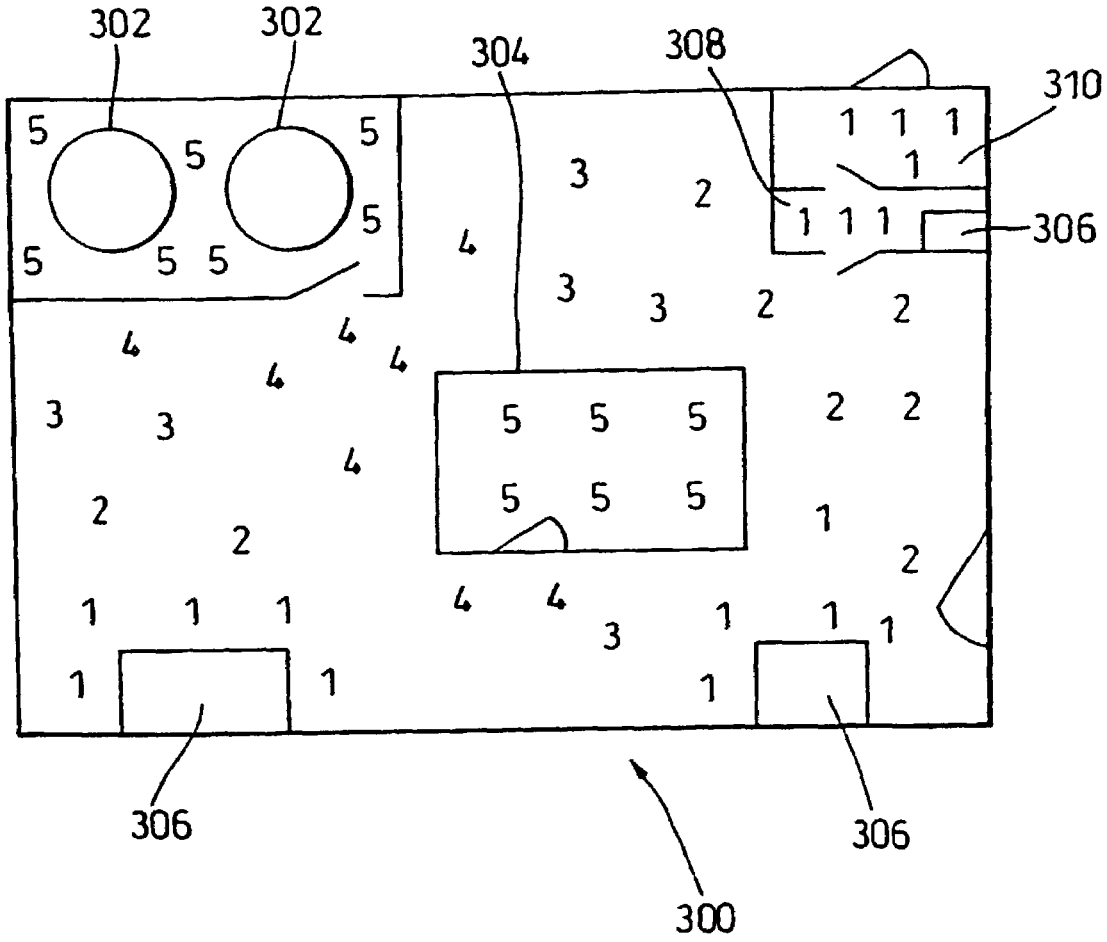
FIG. 8 shows a map of hazard level with position in a factory.

FIG. 9 illustrates a further development. If the position of a user is known, and the level of contamination at their position is known (ambient air sample test) then a map of contamination level for a region can be built up as one or more users move around that region. This map is preferably built up automatically by a computer as the person moves around. FIG. 8 shows a factory 300 having tanks 302 of dangerous chemicals, a processing room 304 where processes using the dangerous chemical are performed, air extractors 306, a decontamination room 308, and a clean changing room 310. It also shows schematically airborne levels of noxious materials by the numbers 1 to 5, with a level of 1 being safe with no respirator being necessary and a level of 5 indicating that it is essential to wear a respirator. The map is generated by a user of the system of FIGS. 4 and 5 walking around and performing their normal duties for a day. The map is useful since it allows "hot spots" of contamination to be located in the factory.

It will be appreciated that the respirator system can acquire data instead of, or in addition to, the data relating to airborne contaminants (and/or Protection Factor). If used as part of a fireproof/heatproof suit it can be used, with the provision of an external temperature sensor, to acquire external temperature data; a microphone (if provided) can be used to monitor external noise levels; a Geiger counter can measure radiation levels; other external conditions may be measured/sensed. A map of external conditions can be built up using the users as mobile sensors. A physiological parameter (such as blood pressure, heart rate, etc.) could be monitored using the system. The respiration rate of a user could be measured/whether they are breathing with a suitable sensor. The sensors may or may not be mounted on the respirator face mask. They could be mounted on a helmet/belts/webbing/clothing/other equipment.

The air-sample connection to the inside of the mask could be via a drinking tube/drinking inlet. The air tube could couple to the drinking tube.

Another useful thing that may result from some embodiments of the invention is the ability to monitor a user's breathing, or breathing pattern by using the respirator. For example one or more transducers, e.g. pressure transducers, may be provided in the respirator to monitor breathing. A sensor may be provided in an exhalation valve of the respirator and/or in the inhalation system, for example in the inhalation canister (e.g. canister 32). Alternatively, the pressure within the respirator mask, controlled by the canister and exhalation valve, can be monitored by a pressure transducer. Algorithms can convert pressure levels into breather flows. Breather flows, or data indicative of breathing, can in turn be used to examine the well being of the user (e.g. casualty levels) and/or establish whether the user is wearing the respirator. This data/information can be supplied back to a central command location.

What is claimed is:

1. A portable respirator system having a respirator, a sensor, and a signal handler each adapted to be worn or carried by a mobile user, in which the respirator includes a mask, in which the sensor comprises an analyser capable of detecting a contaminant that has ingressed inside the mask of the respirator from an environment outside of said respirator and outputting a sensor signal indicative of the level of said contaminant to the signal handler, and in which the signal handler comprises either (i) data storage adapted to store data representative of the sensor signal or (ii) a telecommunication emitter adapted to emit a telecommunications signal indicative of the sensor signal or (iii) both (i) and (ii).

2. A system according to claim 1 further comprising a camera adapted to be worn or carried by the user.

3. A system according to claim 2 in which the data storage is adapted to record data representative of an output of the camera and/or the emitter is adapted to emit a telecommunications signal associated with the output of the camera.

4. A system according to claim 2 further comprising image and data combination or association means adapted in use to associate a parameter or value detected by the sensor with an image recorded by the camera so that a combined or associated processed image is producible in use with the parameter or value displayed at the same time as the camera image.

5. A system according to claim 1 in which the analyser comprises a gas analyser or a particle counter.

6. A system according to claim 1 in which the analyser is adapted to monitor the level of the contaminant in the environment outside the respirator.

7. A system according to claim 1 further comprising a breathing sensor adapted to provide signals indicative of the breathing of the user in the respirator.

8. A system according to claim 7 in which the breathing sensor comprises a pressure sensor adapted to provide signals related to air pressure levels within the respirator.

9. A system according to claim 7 in which the telecommunication emitter is adapted to emit signals indicative of whether the user is wearing the respirator and breathing into it.

10. A system according to claim 7 adapted to monitor the breathing rate of the wearer in use.

11. A system according to claim 7 further comprising signal correlation means adapted to correlate the sensor signal from the level of contaminant and/or the breathing sensor with camera image signals.

12. A system according to claim 1 in which the signal handler comprises data storage in the form of a machine-readable data carrier removably couplable to a data recording device.

13. A system according to claim 1 in which the signal handler comprises data storage comprising any one or more of the following: computer memory, magnetic tape or disc, optical memory, optical recording medium, or magneto-optical recording medium.

14. A system according to claim 1 further comprising a position sensor adapted to provide a signal from which a position of the respirator system in space can be determined.

15. A system according to claim 14 further comprising means, in use, for correlating a position of one or more images of a camera, protection factor, contaminant level outside of the respirator, contaminant level inside the respirator, and physiological data indicative of an aspect of the physiological activity of the user.

16. A system according to claim 1 further comprising an indicator adapted to indicate to the user that the respirator is not succeeding in maintaining a safe breathable atmosphere within the respirator.

17. A system according to claim 1 worn by the user as protective clothing.

18. A system according to claim 1 further comprising a transmitter and receiver system having a receiver adapted to receive transmitted signals, a processor, and a display, and in which, in use, the processor processes received signals and provides the display with display signals which generate a visual representation of a parameter for which the sensor signal is indicative.

19. A system according to claim 18 in which the processor and the display are adapted to provide a visual image recorded by the camera.

20. A method of testing the efficacy of a respirator comprising providing a sensor associated with the respirator, which sensor comprises a portable analyser adapted to detect the level of a contaminant that has ingressed inside a mask of the respirator from an environment outside of the respirator and, at substantially the same time, the contaminant level outside of the respirator, and comparing the contaminant levels inside and outside of the respirator.

21. A method according to claim 20 further comprising the user performing exercises in a workplace environment.

22. A method according to claim 20 further comprising the user performing duties consistent with expected usage of the respirator.

23. A method according to claim 20 further comprising providing a breathing sensor and determining information about the breathing rate and/or the flow or volume of breaths of the user.

24. A method according to claim 20 further comprising informing a remote station of the results of the test in real time by having the respirator and associated analyser in communication with the remote station.

25. A method according to claim 20 further comprising recording test data in a recording device ported by the user and/or determining the position of the user.

26. A method according to claim 20 further comprising recording visual images during the test.

27. A method according to claim 26 further comprising associating test data with the visual images.

28. A method according to claim 26 further comprising simultaneously visually displaying the visual images with test data or a parameter derived from test data.

29. A method according to claim 20 in which the analyser comprises a gas analyser or a particle counter.

* * * * *